US005311265A

United States Patent [19]

Miller

[11] Patent Number: 5,311,265

[45] Date of Patent: May 10, 1994

[54] TONER LOADING SYSTEM AND METHOD

[75] Inventor: Timothy J. Miller, Webster, N.Y.

[73] Assignee: Xerox Corporation, Stamford, Conn.

[21] Appl. No.: 996,291

[22] Filed: Dec. 23, 1992

[51] Int. Cl.[5] ..... G03G 15/06

[52] U.S. Cl. ..... 355/260; 222/DIG. 1

[58] Field of Search ..... 355/260, 245, 246; 222/DIG. 1; 141/364, 363

[56] References Cited

U.S. PATENT DOCUMENTS

| | | | |
|---|---|---|---|
| 4,062,385 | 12/1977 | Katusha et al. | 222/DIG. 1 X |
| 4,599,851 | 7/1986 | Williams | 53/471 |
| 5,040,024 | 8/1991 | Fukuda et al. | 355/260 |
| 5,074,344 | 12/1991 | Vacek et al. | 355/260 X |
| 5,089,854 | 2/1992 | Kaieda et al. | 355/260 |
| 5,101,871 | 4/1992 | Susumu | 141/364 |
| 5,142,335 | 8/1992 | Sakata et al. | 355/260 |
| 5,150,807 | 9/1992 | Seyfried et al. | 355/260 X |
| 5,177,540 | 1/1993 | Honda et al. | 355/260 |
| 5,194,900 | 3/1993 | Hagihara et al. | 355/260 |
| 5,207,353 | 5/1993 | Corby et al. | 222/DIG. 1 |

FOREIGN PATENT DOCUMENTS

| | | |
|---|---|---|
| 55-90979 | 7/1980 | Japan . |
| 63-137257 | 6/1988 | Japan . |
| 1-173076 | 7/1989 | Japan . |
| 2-63079 | 3/1990 | Japan . |
| 3-158872 | 7/1991 | Japan . |

*Primary Examiner*—Matthew S. Smith
*Assistant Examiner*—Nestor R. Ramirez
*Attorney, Agent, or Firm*—Oliff & Berridge

[57] ABSTRACT

A toner loading system for use with reprographic machines which reduces powder clouding and minimizes toner spill during loading. A toner cartridge is mountable on a toner housing. The housing includes an opening sized to accept the cartridge. When in a raised position, the cartridge is on top of the housing. When in a lowered position, the cartridge is positioned within the housing through the opening. A removable seal on the bottom of the cartridge includes a long pull tab which can be grasped from above the housing, when the cartridge is lowered, to allow removal of the seal and allow flow of toner from the cartridge to the housing while the cartridge is extended substantially or completely within the housing, thus reducing powder clouding, providing more even toner flow, and reducing mess or spillage. The reduced powder clouding is due to a substantially reduced height from which the toner has to fall when being loaded into the housing.

15 Claims, 6 Drawing Sheets

TONER LOADING SYSTEM AND METHOD

BACKGROUND OF THE INVENTION

1. Field of the Invention

The present invention relates to a toner loading system for use with reprographic machines which reduces powder clouding and minimizes toner spill during loading.

2. Description of Related Art

There are known various toner cartridges which can replenish toner to a toner housing of a machine such as a reprographic device. There is a need for such cartridges to be easy to use such that a user can easily replace toner in the toner housing without spilling on the user, on outer surfaces of the toner housing or on other surfaces within the reprographic device. Known cartridges and toner replenishing methods utilize a mechanism which locks or otherwise attaches a toner cartridge onto a top surface of the toner housing. Many have mechanisms to open or close apertures in the top of the toner housing such that toner can enter the housing. Some known cartridges include a removable seal on a lower side of the cartridge. Upon attachment of the cartridge on top of the housing, the seal can be removed and the toner flows down into the aperture of the housing.

However, there are problems with current apparatus and methods. One problem is that toner dust clouding occurs upon releasing of toner from the cartridge. Once the toner cartridge is emptied, there are many instances when upon removal of the cartridge, toner particles which have clouded and become dispersed in the air within the toner housing can escape the aperture of the housing and cause unwanted mess. There is a need for a toner cartridge and a dispensing method which allow for simple replenishment of toner while substantially reducing toner dust clouding.

OBJECTS AND SUMMARY OF THE INVENTION

It is an object of the present invention to provide a toner loading system which minimizes toner dust clouding during loading.

It is another object of the present invention to provide a reliable toner cartridge and a mating toner housing which allow for removal of a retaining seal after insertion of the cartridge within the housing to achieve the above object by substantially reducing the height that the toner has to drop when being loaded into the housing.

The above and other objects are achieved by providing a refill powder toner cartridge for a reprographic device which comprises a cartridge body having a top wall, a bottom wall and side walls which enclose an interior storage area for retaining toner powder. The side walls extend along a longitudinal axis and the bottom wall includes an aperture in communication with the storage area. A flange may be attached to the cartridge, the flange being movable between an open position and a closed position. In the closed position, the cartridge body is fixedly retained by the flange. In the open position, the flange defines an aperture sized to permit longitudinal movement of the cartridge body through the flange aperture while restricting movement along other axes. A toner housing of a reprographic device may have a mating feature which attaches the cartridge body or cartridge flange to the top of the housing. When the cartridge is installed on top of the toner housing, the cartridge body can be lowered within an opening in the housing in communication with a toner storage cavity. If a cartridge flange is used, the flange must be moved to the open position before the cartridge body can be lowered within the opening. Once lowered, a removable seal can be removed from the bottom of the cartridge body allowing toner to flow from the cartridge body into the housing. The cartridge body can then be slowly withdrawn from the storage cavity while the toner is being emptied from the cartridge body to refill the storage cavity with reduced powder clouding.

These and other objects will become apparent from a reading of the following detailed description in connection with the drawings.

BRIEF DESCRIPTION OF THE DRAWINGS

The invention will be described in detail with reference to the following drawings wherein.

Figure 1:
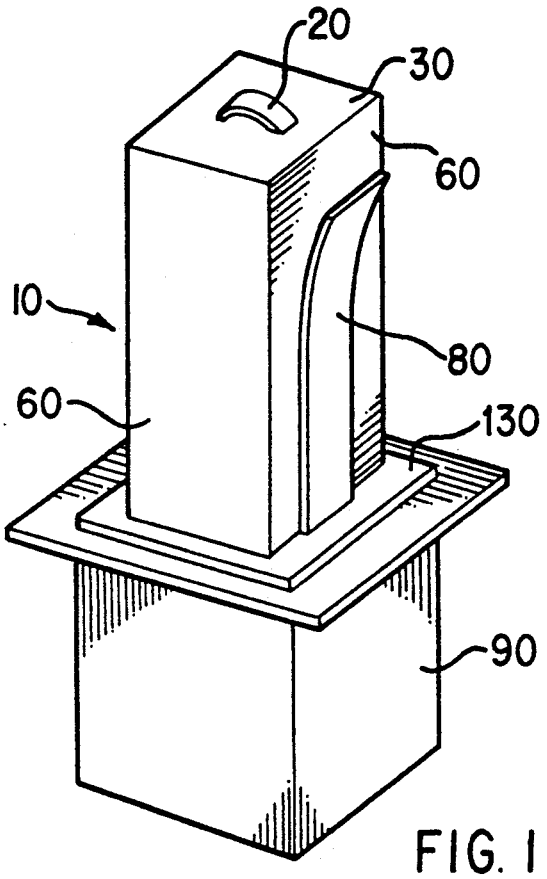
FIG. 1 is an isometric view of a cartridge just prior to insertion in a toner housing according to the present invention.

DETAILED DESCRIPTION OF PREFERRED EMBODIMENTS with reference to FIG. 1, the present invention provides a toner cartridge 10 with a handle 20 on a top wall 30 of cartridge 10 and a removable seal 40 on the bottom wall 50 of cartridge 10 from retaining a supply of fresh toner 100 (FIG. 4) in cartridge 10. Cartridge 10 additionally has side walls 60 which define a longitudinal periphery of a desired shape. For simplicity, the cartridge 10 has been shown as being substantially square. However, it is contemplated that the cartridge 10 can have side walls 60 which form cylindrical, rectangular, oval, polygonal and other shapes. Removal seal 40 can have any desired bottom shape. The seal 40 can cover an entirely open bottom wall 50 or can be sized to cover a hole or open cross-sectional area of predetermined dimensions of bottom wall 50 which forms a cartridge aperture 70. The aperture 70 communicates an exterior of the cartridge with an interior portion which contains a supply of toner 100.

Figure 4:
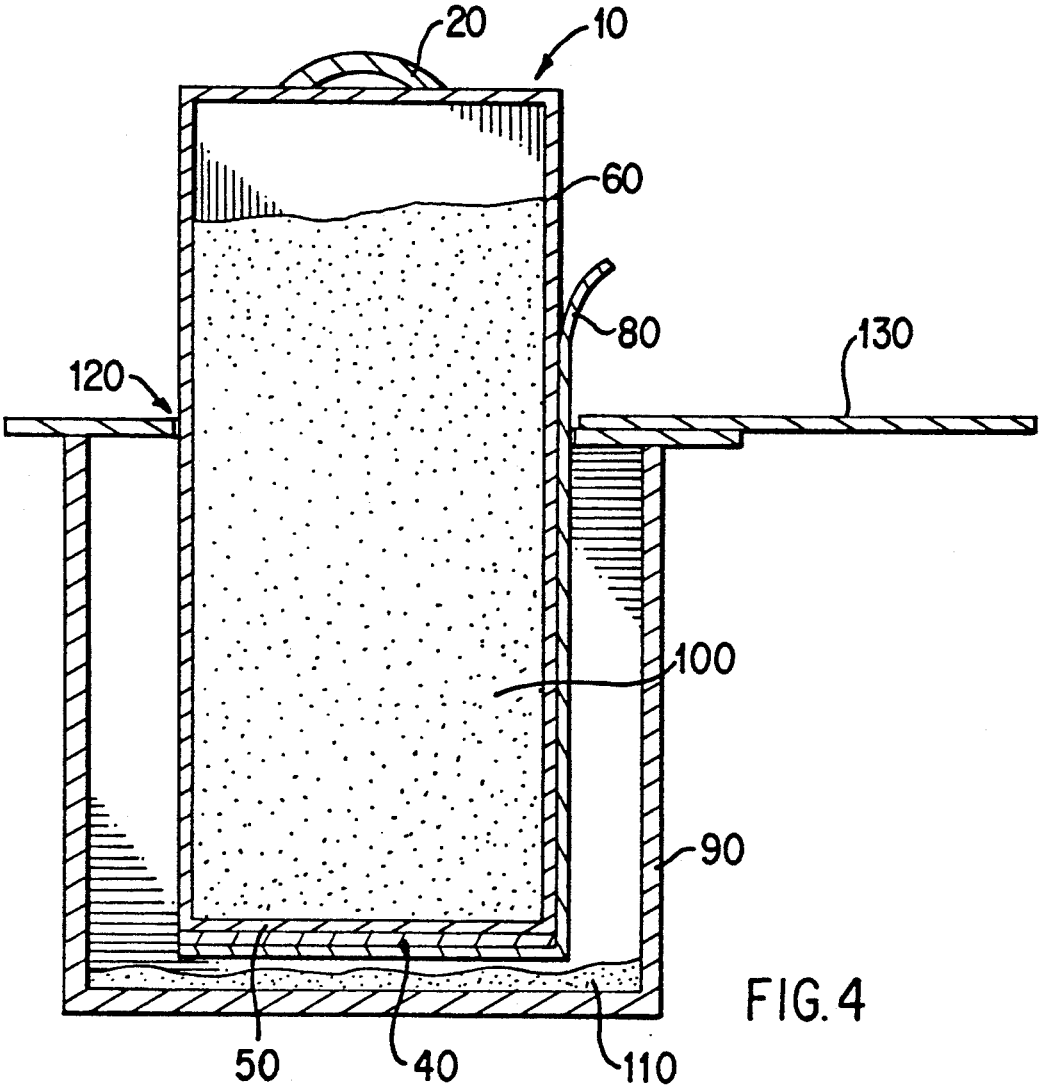
FIG. 4 is a cross-sectional view of the toner cartridge and toner housing of FIG. 1 taken along line 4–4.
Figure 5:
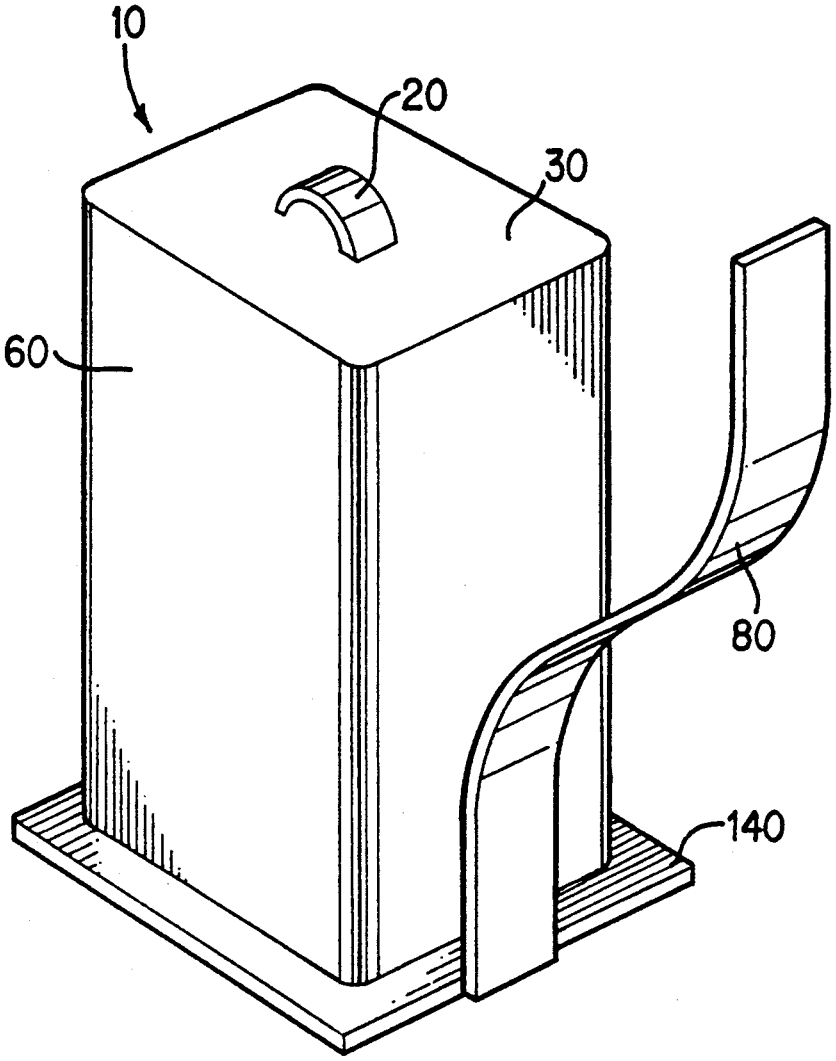
FIG. 5 is an isometric view of an alternative cartridge according to the present invention.

Preferably, the seal 40 includes a long pull tab 80 attached to a portion of seal 40 to allow tearing or removal of seal 40 upon pulling of pull tab 80. A reprographic machine includes a toner housing 90 which houses an exhaustible supply of toner 110 (FIG. 4). When the supply of toner 110 is low or empty, fresh toner 100 can be added by insertion of cartridge 10 within housing 90 (FIG. 2) through a housing opening 120 followed by pulling on pull tab 80 to remove seal 40 and allow release of fresh toner 100 from cartridge 10 into housing 90.

Figure 2:
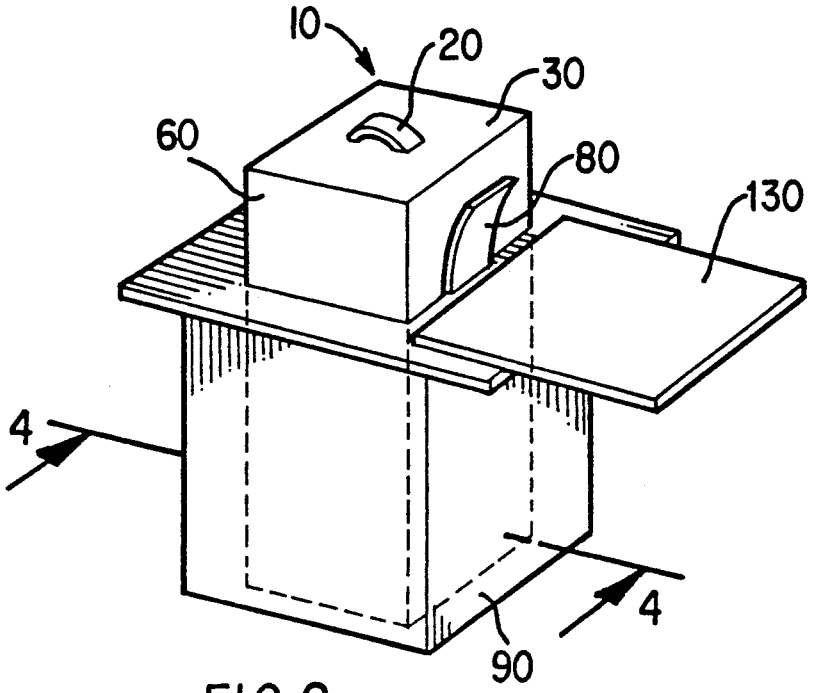
FIG. 2 is an isometric view of the cartridge of FIG. 1 with the cartridge inserted within the housing in a loading configuration.

In a simple form, the opening 120 of toner housing 90 may be covered by a removable cover 130 (FIG. 1). Cartridge 10 can be placed over opening 120 and cover 130 can be removed or otherwise shifted to expose opening 120 to cartridge 10. Upon opening of cover 130, cartridge 10 can be longitudinally moved within toner housing 90 through opening 120 as shown in FIG. 2. Once the cartridge 10 has been lowered sufficiently into an interior storage cavity of the housing 90, tab 80 can be pulled, thus gradually exposing cartridge aperture 70 allowing fresh toner flow out of cartridge 10 and into toner housing 90. Since the cartridge 10 is located a substantial distance within toner housing 90, i.e., the cartridge bottom wall 50 is located at or substantially near a bottom of toner housing 90, there is a substantially reduced distance which the toner 100 has to fall until it reaches an upper surface of existing toner 110 or a bottom of housing 90 if the housing is substantially or completely empty of toner 110. This substantially reduces toner dust clouding and allows for a smoother flow of toner from cartridge 10.

Additionally, by controlling the tear or removal rate of the seal 40 from cartridge 10, the toner 100 flow out of the cartridge 10 and into housing 90 can gradually increase as the exposed aperture 70 at the bottom wall 50 of cartridge 10 increases in area, thus smoothly filling housing 90.

Figure 3:
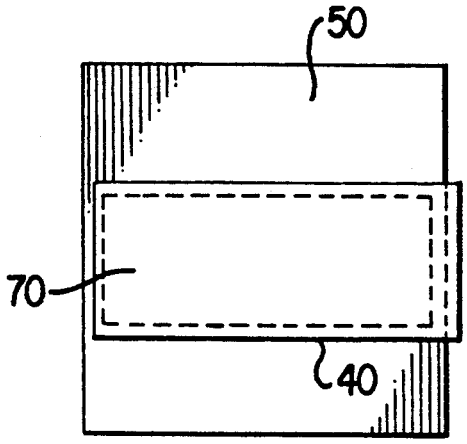
FIG. 3 is a bottom view of a toner cartridge according to the present invention.

As shown in FIGS. 3 and 4, aperture 70 of cartridge 10 is of a predetermined size which allows toner to be released from cartridge 10. Seal 40 is sized to completely cover aperture 70 and can be made from any suitable material such as heat sealable polymer, for example, a polyester film or a woven polypropylene coated with a hot melt adhesive. A preferred composition is a known heat sealable tape TYVEK manufactured by DuPont.

As better shown in FIG. 4, pull tab 80 and seal 40 are integral and form an overlapped layer on the bottom wall 50 covering the cartridge aperture 70. The seal 40 forms a layer directly in contact with bottom wall 50 and is integrally attached to pull tab 80 at a leftmost part of cartridge 10 as shown. The pull tab 80 overlaps the seal layer and extends upward along a right side wall 60 of cartridge 10. The pull tab 80 has a length which is sufficiently longer than a depth of the housing 90 such that upon full insertion of the cartridge 10 within housing 90, a sufficient portion of pull tab 80 remains above the toner housing 90 allowing pull tab 80 to be easily grasped. Pulling of pull tab 80 results in the leftmost portion of seal 40 gradually being released from bottom wall 50 to gradually open aperture 70 allowing flow of toner 100 out of the cartridge 10 and into toner cavity within housing 90. The extent of flow rate depends on the speed at which the pull tab 80 is pulled and the size of aperture 70.

Once pull tab 80 and seal 40 have been fully removed and the cartridge contents have started dropping, the cartridge 10 can be slowly raised by using handle 20 to return the cartridge 10 to the original position (same as in FIG. 1 only pull tab 80 and seal 40 are now missing). When properly raised, cartridge bottom 50, and thus aperture 70, remains at or only substantially a small distance above an uppermost surface of the toner within housing 90 such that toner drop distance and velocity are substantially minimized. Once the contents of cartridge 10 have been emptied and the cartridge 10 has been fully raised back to the original position, the cover 130 can be returned to a closed position to seal off the toner housing and the cartridge 10 can be removed. Optionally, since there is substantially reduced or eliminated toner dust clouding, the cartridge 10 can be removed prior to closing of cover 130 without toner dust cloud particles being expelled from the toner housing 90. This significantly reduces toner mess which can accumulate on external surface of the toner housing and on the user, allowing a user to replenish toner without a skilled operator.

Figure 6:
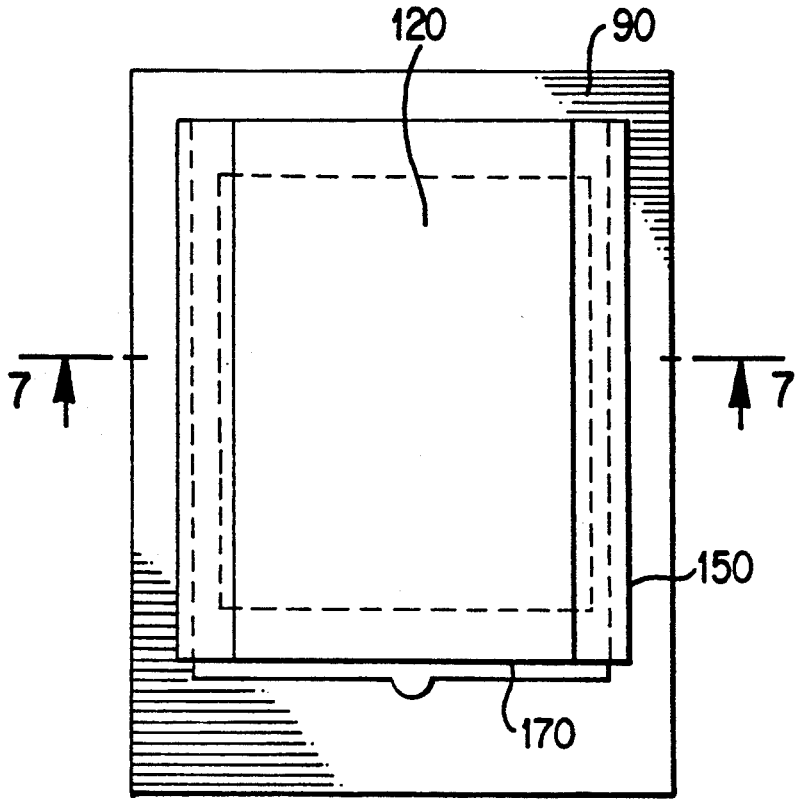
FIG. 6 is a top view of a mating mechanism on the toner housing in an alternative embodiment.
Figure 7:
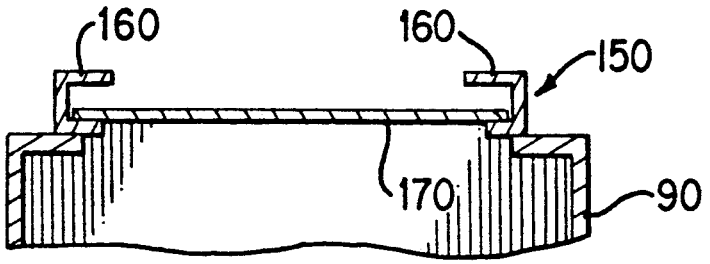
FIG. 7 is a cross-sectional view of the mating mechanism of FIG. 6 taken along line 7—7.
Figure 8:
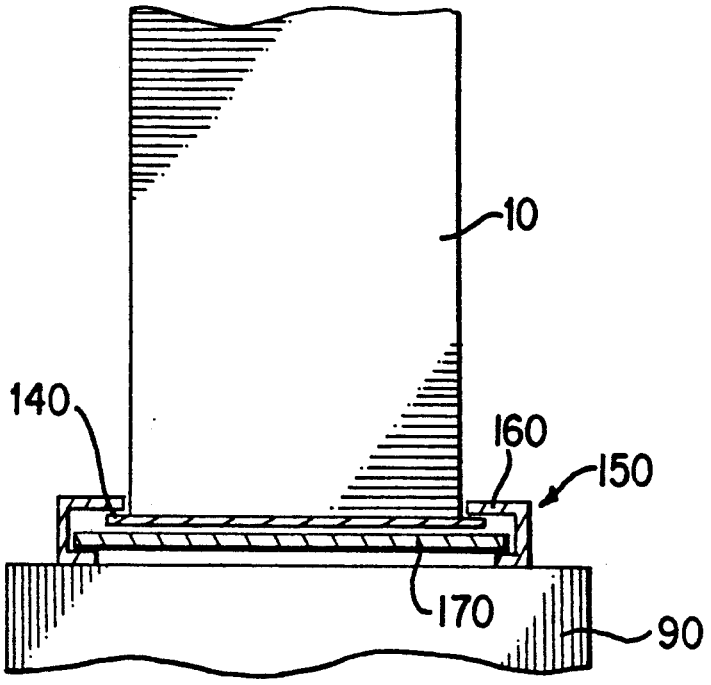
FIG. 8 is a side view of the mating mechanism of FIG. 6 mated with the toner cartridge of FIG. 5.

An alternative embodiment shown in FIGS. 5–8 includes a cartridge 10 having a lower flange 140. As shown in FIGS. 6–8, housing 90 includes a mating feature 150 mounted on or integrally a part of a top surface of housing 90. Mating feature 150 has inverted L-shaped guide rails 160 which guide and engage with flange 140 to allow slidable movement of cartridge 10 over opening 120 of housing 90 (FIG. 6). Opening 120 is sized to allow longitudinal movement of cartridge 10 within housing 90, i.e., the periphery of opening 120 is substantially the same or slightly larger than the periphery of cartridge 10 which in this example is defined by the periphery of flange 140. As better shown in FIG. 8, the guide rails are spaced a distance substantially the same as width of side walls 60 such that the cartridge 10 is precisely aligned during slidable movement within guide rails 160. Abutment stops may be provided on the mating feature to aid in positioning cartridge 10 directly over opening 120 of housing 90.

Guide rails 160 extends toward one another such that the distance between the guide rails is less than the width of the flange 140. This prevents upward movement of the cartridge once positioned within the guide rails 160. However, as shown, the flange is sized substantially the same or slightly smaller than opening 120 to allow movement of the cartridge 10 into housing 90.

Initially, opening 120 is closed off by a slidable cover member 170. Cover member 170 also restrains cartridge 10 from entry within housing 90. Sliding of cover member 170 to fully expose opening 120 allows cartridge 10 to extend within housing 90. The cartridge 10 is preferably fully extendable within housing 90 such as aperture 70 of cartridge 10 can contact with or at least substantially contact a bottom wall of housing 90. This as previously described reduces toner falling distance to minimize toner dust clouding.

Once the toner 100 is released from cartridge 10 the cartridge is extended upward by pulling on handle 20 until the cartridge 10 is once again in engagement with guide rails 160. Once in this position, the cartridge can be slidably removed from guide rails 160 on housing 90 and disposed of.

Cover member 170 can be returned to a position either before or after removal of cartridge 10 from guide rails 160.

Optionally, cover member 170 can be provided with wiping means on top or bottom surfaces thereof to prevent spillage of toner particles which may remain on bottom wall 50 fo the cartridge or on the cover member 170 itself.

Figure 9:
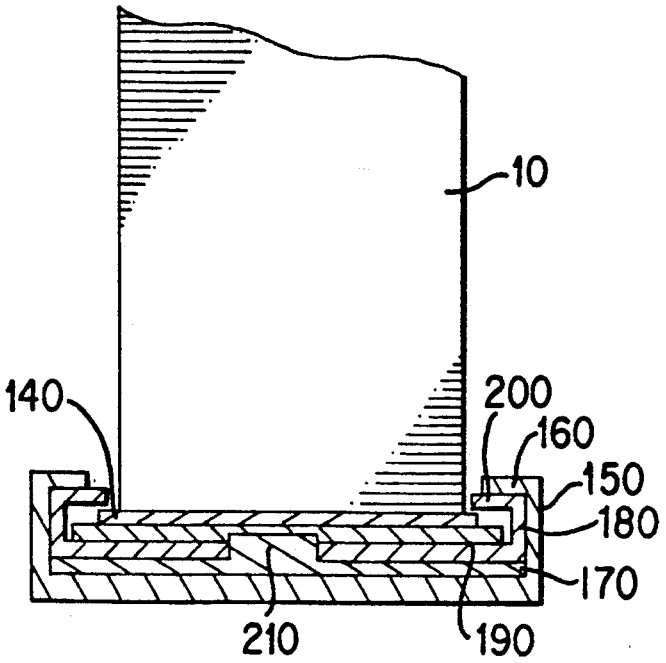
FIG. 9 is a side view of a cartridge, a mating mechanism, a cartridge flange and a toner housing according to another embodiment.
Figure 10:
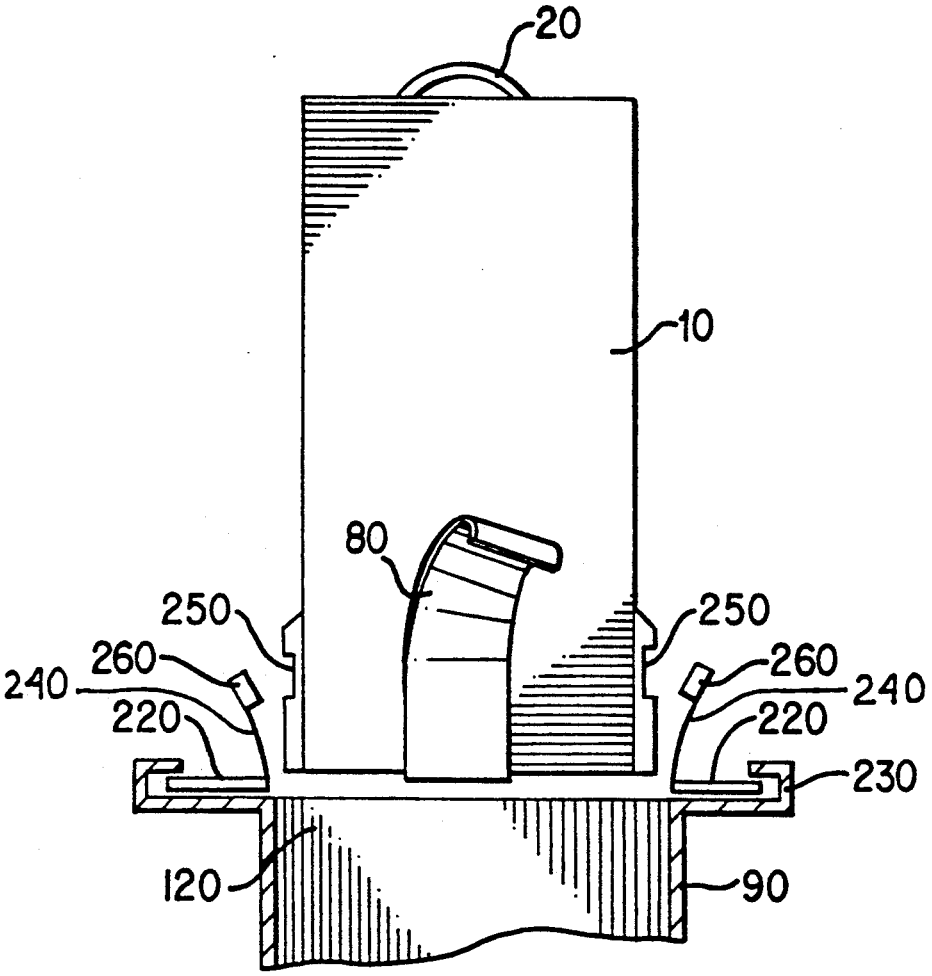
Fig. 10 is a side view of a toner loading system according to a further embodiment.

According to a further embodiment, as shown in FIG. 9, cartridge 10 may be provided with a retaining flange 180 which may resemble mating feature 150. Flange 180 includes a slidable cover 190 and additionally has guide rails 200. In this configuration, cover 190 is movable horizontally between open and open positions. In the closed position, aperture 70 is exposed. In the closed position, aperture 70 is sealed.

Cover 190 may havewiping means or sealing means such as a resilient layer which can seal off the bottom of the cartridge and prevent spillage of any remaining toner particles not completely dispensed from cartridge 10 after seal 40 has been removed and the cartridge has been returned to the original raised position.

Guide rails 200 prevent upward movement of cartridge 10 relative to flange 180. As with mating feature 150, flange 180 includes an opening sized to allow longitudinal passage of cartridge 10 therethrough.

In this embodiment, flange 180 is slidable horizontally along guide rails 160 of mating feature 150. Upon opening of both cover 190 and cover member 170, cartridge 10 is capable of being positioned within housing 90.

Cover member 170 and cover 190 may be independently operated or may be jointly operated. For example, cover member 170 may be biased to the closed position by suitable biasing means such as a spring and cover 170 further could include an upwardly extending tab 210 which extends above a horizontal plane through which cover 190 is slidable movable therein. This structure results in tab 210 of cover member 170 contacting cover 190 upon opening of cover 190. This allows covers 170 to move with cover 190. Closing of cover 190 results in closing of cover member 170 due to the biasing means.

This embodiment provides a closable toner housing 90 and a closable toner cartridge 10. This further reduces chances of toner spillage or mess since after emptying of cartridge 10, cover 190 can be returned to the closed position prior to removal of cartridge 10 from housing 90 to seal remaining cartridge contents from spilling. This also links closing of the toner cartridge with closing of the toner housing.

According to yet another embodiment, the cartridge 10 has a retaining flange 220 which mates with a mating feature 230 to position and retain cartridge 10 over opening 120 in toner housing 90. The flange 220 has an upwardly extending portion 240 which guides and restrains cartridge 10. Cartridge 10 includes a notch 250 which can extend entirely around the cartridge or may be formed on select portions of exterior sides of the cartridge 10. One or more flexible tabs 260 are provided on portion 240 of flange 220 to retain cartridge 10. The tabs 260 are designed to mate with notch 250 to fixedly retain cartridge 10 in a raised position. By bending flexible tabs 260 and breaking mating contact with notch 250, i.e., opening the tabs of the flange, cartridge 10 is longitudinal movable through the flange 220 and into toner housing 90. Raising of cartridge 10 to the raised position once again establishes mating contact between tabs 260 and 250, thus retaining cartridge 10 in the raised position and closing the tabs 260 of the flange 220.

The invention has been described with reference to the preferred embodiments thereof, which are illustrative and not limiting Various changes may be made without departing from the spirit and scope of the invention as defined in the appended claims.

What is claimed is:

1. A toner refill system for a reprographic device comprising:

a cartridge body having a top wall, a bottom wall and side walls that enclose an interior storage area for retaining toner powder, said side walls extending about a longitudinal axis, said body defining a longitudinal periphery, said bottom wall having an aperture in communication with said storage area;

a flange attached to said cartridge, said flange being movable between a closed position in which said cartridge body is fixedly retained and restricted from longitudinal movement relative to said flange and an open position in which said flange defines an opening sized to permit longitudinal movement of said cartridge body through said flange aperture while restraining said cartridge body from motion in substantially all other axes;

a toner housing affixed to the reprographic device, said toner housing including a toner housing storage cavity having a bottom wall defining a depth and having an upper surface which releasably mates with said cartridge flange and includes an opening sized equal to or greater than the longitudinal periphery of said cartridge body, said opening communicating with said toner housing storage cavity; and a removable seal that extends across and seals the cartridge body aperture to retain dry powder within said storage area of said cartridge body, said removable seal including an integral pull tab extending longitudinally along one said side walls a distance greater than said depth of said toner housing storage cavity, said bottom wall of said cartridge body being completely extendable within the depth of said toner housing storage cavity.

2. The toner refill system of claim 1, wherein when said flange is mated with said upper surface of said toner housing and when said flange is in the open position, said cartridge body is longitudinally extendable within said toner storage cavity of said toner housing.

3. The toner refill system of claim 1, wherein said seal is made from a heat seal strip formed from woven polypropylene.

4. The toner refill system of claim 1, wherein said cartridge body extends along the longitudinal axis a distance greater than the depth of said toner housing storage cavity.

5. A toner refill method for refilling a toner housing of a reprographic device using a refill cartridge which is mounted on the housing, the cartridge having a removable seal on a bottom wall of the cartridge which can be removed using an integral pull tab, the housing having a bottom defining a storage cavity of a depth, the method comprising the sequential steps of:

(a) attaching the cartridge body to the toner housing to position the cartridge in a raised position above the housing;

(b) lowering the cartridge into the storage cavity until the bottom wall of the cartridge has been lowered substantially the entire depth of the storage cavity;

(c) removing the seal using the pull tab to release toner from the cartridge and into the storage cavity;

(d) raising the cartridge from within the storage cavity back to the raised position; and (e) removing the cartridge from the toner housing.

6. The method of claim 5, wherein step (c) lowers the bottom wall of the cartridge into engagement with a bottom of the housing cavity.

7. The method of claim 5, wherein step (d) is performed at a slow rate while toner particles are still falling from the cartridge into the cavity.

8. A toner refill method for refilling a toner housing of a reprographic device using a refill cartridge which is mounted on a flange for longitudinal movement when the flange is in an open position and fixedly retained when the flange is in a closed position, the cartridge having a removable seal on a bottom wall of the cartridge which can be removed using an integral pull tab, the housing having a bottom defining a storage cavity of a depth, an opening which communicates with the cavity and a mating feature for attaching the flange onto the housing, the method comprising the sequential steps of:

(a) attaching the cartridge body to the toner housing using the flange and the mating feature to position the cartridge in a raised position above the housing;

(b) positioning the flange of the cartridge in the open position;

(c) lowering the cartridge into the storage cavity until the bottom wall of the cartridge is lowered substantially the entire depth of the storage cavity;

(d) removing the seal using the pull tab to release toner from the cartridge and into the storage cavity;

(e) raising the cartridge from within the storage cavity back to the raised position;

(f) returning the flange to the closed position; and (g) removing the cartridge from the toner housing.

9. The method of claim 8, wherein step (b) also opens the aperture in the mating feature to allow the cartridge to be lowered into the cavity.

10. The method of claim 9, wherein step (f) closes the aperture in the mating feature.

11. The method of claim 8, wherein step (c) lowers the bottom wall of the cartridge into engagement with a bottom of the housing cavity.

12. The method of claim 8, wherein step (d) is performed at a slow rate while toner particles are still falling from the cartridge into the cavity.

13. A toner refill system for a reprographic device comprising:

a cartridge body having a top wall, a bottom wall and side walls which enclose an interior storage area for retaining toner powder, said side walls extending about a longitudinal axis, said body defining a longitudinal periphery, said bottom wall having an aperture in communication with said storage area;

a toner housing affixed to the reprographic device, said toner housing defining a toner housing storage cavity having a depth and having an upper surface which releasably mates with said cartridge and includes an opening communicating with said toner housing storage cavity sized equal to or greater than the longitudinal periphery of said cartridge body allowing said cartridge body to be substantially insertable through the entire depth of said storage cavity;

a removable seal covering the aperture; and a flange for releasably retaining said cartridge, said flange having flexible tabs which releasably retain said cartridge in a raised position.

14. The toner refill system of claim 13, further comprising a pull tab attached to said removable seal, said pull tab extending up one of said side walls a distance greater than the depth of said cavity.

15. The toner refill system of claim 13, further comprising a notch on said cartridge which mates with said flexible tabs.

* * * * *